United States Patent [19]

Henzel et al.

[11] Patent Number: 4,737,485

[45] Date of Patent: Apr. 12, 1988

[54] SILICONE AND PHOSPHATE ESTER SLIPPING LAYER FOR DYE-DONOR ELEMENT USED IN THERMAL DYE TRANSFER

[75] Inventors: Richard P. Henzel; Kin K. Lum, both of Webster; Noel R. Vanier, Rochester, all of N.Y.

[73] Assignee: Eastman Kodak Company, Rochester, N.Y.

[21] Appl. No.: 76,433

[22] Filed: Jul. 21, 1987

Related U.S. Application Data

[63] Continuation-in-part of Ser. No. 923,442, Oct. 27, 1986, abandoned.

[51] Int. Cl.[4] ..... B41M 5/26

[52] U.S. Cl. ..... 503/227; 8/471; 427/146; 427/256; 428/195; 428/341; 428/447; 428/480; 428/483; 428/522; 428/704; 428/913; 428/914; 430/945

[58] Field of Search ..... 8/470, 471; 427/146, 427/256; 428/195, 207, 340–342, 447, 480, 483, 484, 488.1, 488.4, 522, 704, 913, 914; 430/945; 503/227

[56] References Cited

U.S. PATENT DOCUMENTS

| | | | |
|---|---|---|---|
| 4,559,273 | 12/1985 | Kutsukake et al. | 428/914 |
| 4,567,113 | 1/1986 | Ohtsu et al. | 428/914 |

FOREIGN PATENT DOCUMENTS

| | | | |
|---|---|---|---|
| 138483 | 4/1985 | European Pat. Off. | 503/227 |
| 163145 | 4/1985 | European Pat. Off. | 503/227 |
| 169705 | 1/1986 | European Pat. Off. | 503/227 |

*Primary Examiner*—Bruce H. Hess
*Attorney, Agent, or Firm*—Harold E. Cole

[57] ABSTRACT

A dye-donor element for thermal dye transfer comprising a support having on one side thereof a dye layer and on the other side a slipping layer comprising a lubricating material dispersed in a polymeric binder, the lubricating material comprising a partially esterified phosphate ester and a silicone polymer comprising units of a linear or branched alkyl or aryl siloxane.

22 Claims, No Drawings

SILICONE AND PHOSPHATE ESTER SLIPPING LAYER FOR DYE-DONOR ELEMENT USED IN THERMAL DYE TRANSFER

This is a continuation-in-part of U.S. Ser. No. 923,442, filed Oct. 27, 1986, now abandoned.

This invention relates to dye-donor elements used in thermal dye transfer, and more particularly to the use of a certain slipping layer, comprising a lubricating material dispersed in a polymeric binder, the lubricating material being a partially esterified phosphate ester and a silicone polymer comprising units of a linear or branched alkyl or aryl siloxane, on the back side thereof to prevent various printing defects and tearing of the donor element during the printing operation.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. This causes intermittent rather than continuous transport across the thermal head. The dye transferred thus does not appear as a uniform area, but rather as a series of alternating light and dark bands (chatter marks). Another defect called "smiles", which are crescent shaped low density areas, is produced in the receiving element by stretch-induced folds in the dye-donor. Another defect is produced in the receiving element when abraded or melted debris from the backing layer builds up on the thermal head and causes steaks parallel to the travel direction and extending over the entire image area. In extreme cases, sufficient friction is often created to tear the dye-donor element during printing. It would be desirable to eliminate such problems in order to have a commercially acceptable system.

European Patent Application No. 138,483 relates to dye-donor elements having a slipping layer on the back side thereof comprising a lubricant in a resin binder along with particulate material. A large list of lubricating materials is disclosed including various silicone and fluorine-containing surface active agents. The use of those materials in combination is not specifically taught, however. In addition, the slipping layer in that publication has a rough surface due to the presence of particulate material in order to prevent the dye-donor sheet from sticking to the thermal printing head. Such particulate material could have an abrading effect on the printing head, however, and is undesirable for that reason.

U.S. Pat. No. 4,567,113 also relates to dye-donor elements having a slipping layer on the back side thereof comprising various materials including phosphoric acid esters. European Patent Applications Nos. 163,145 and 169,705 also disclose various materials for slipping layers including compounds having a perfluoroalkyl group, silicone materials and fluorine-containing surface active agents. There is no disclosure in these references, however, of the use of the combination of materials taught by this invention to improve the performance of the slipping layer.

Accordingly, this invention relates to a dye-donor element for thermal dye transfer comprising a support having on one side thereof a dye layer and on the other side a slipping layer comprising a lubricating material dispersed in a polymeric binder, and wherein the lubricating material is a partially esterified phosphate ester and a silicone polymer comprising units of a linear or branched alkyl or aryl siloxane.

In a preferred embodiment of the invention, the silicone material is present in an amount of from about 0.0005 to about 0.05 g/m$^2$, representing approximately 0.1 to 10% of the binder weight, the phosphate ester is present in an amount of from about 0.001 to about 0.150 g/m$^2$, representing approximately 0.2 to 30% of the binder weight, and the polymeric binder is a thermoplastic binder representing about 1 to about 80% of the total layer coverage.

Any silicone polymer can be employed in the invention providing it contains units of a linear or branched alkyl or aryl siloxane. In a preferred embodiment of the invention, the silicone polymer is a copolymer of a polyalkylene oxide and a methyl alkylsiloxane. This material is supplied commercially by BYK Chemie, USA, as BYK-320 ®. Another suitable silicone material is a polyoxyalkylene-dimethylsiloxane copolymer, sold as BYK-301 ®. Other suitable silicone materials include linear or pendant polyoxyalkylene-group block copolymers.

Any partially esterified phosphate ester can be employed in the invention. In a preferred embodiment, the partially esterified phosphate ester contains one or two substituted or unsubstituted alkyl groups having from 5 to about 20 carbon atoms such as $C_8H_{17}O—CH_2CH_2—$, $C_6F_{13}OC_2H_2—$, $C_2H_5O(CH_2CH_2O)_6—CH_2CH_2—$, $C_{12}H_{25}—$, $C_{16}H_{33}—$, $HO(CH_2CH_2O)_5—CH_2CH_2—$, $$CN—(CH_2)_4—\underset{\underset{(CH_2)_4CN}{|}}{CH}—;$$

or one or two substituted or unsubstituted aryl groups having from about 6 to about 20 carbon atoms, such as $C_6H_5—CH_2—$, $C_6H_5—CH_2O(CH_2CH_2O)_{10}—CH_2CH_2—$, $p—C_9H_{19}——C_6H_4)—$, $2,4(n—CH_3OCH_2CH_2)(C_6H_3)—$, $p—C_8F_{17}—(C_6H_4)—O(CH_2CH_2—O)_3—CH_2CH_2—$, $p—CN—(C_6H_4)—O(CH_2CH(CH_3)O)_2—CH_2CH_2—$; such groups having from 0 to about 30 linking groups such as alkylene oxide, sulfonamide, amide, carbonyl, sulfide, sulfone, imide, etc. In a highly preferred embodiment, the partially esterified phosphate ester contains one of two fluorinated alkyl or aryl groups. An example of such a material is the following

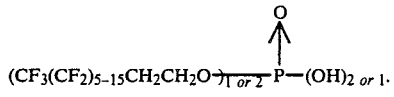

This material is supplied commercially by duPont as Zonyl UR® Fluorosurfactant. Another suitable partially esterified phosphate ester is Gafac RA-600® (GAF Corp.) which is described as a complex phosphate mono- and di-ester of nonionic surfactants of the ethylene-oxide adduct type.

Any polymeric binder can be used in the slipping layer of the invention provided it has the desired effect. In a preferred embodiment of the invention, thermoplastic binders are employed. Examples of such materials include, for example, poly(styrene-co-acrylonitrile) (70/30 wt. ratio); poly(vinyl alcohol-co-butyral) (available commercially as Butvar 76® by Dow Chemical Co.; poly(vinyl alcohol-co-acetal); poly(vinyl alcohol-co-benzal); polystyrene; poly(vinyl acetate); cellulose acetate butyrate; cellulose acetate; ethyl cellulose; bisphenol-A polycarbonate resins; cellulose triacetate; poly(methylmethacrylate); copolymers of methyl methacrylate; poly(styrene-co-butadiene); and a lightly branched ether modified poly(cyclohexylene-cyclohexanedicarboxylate):

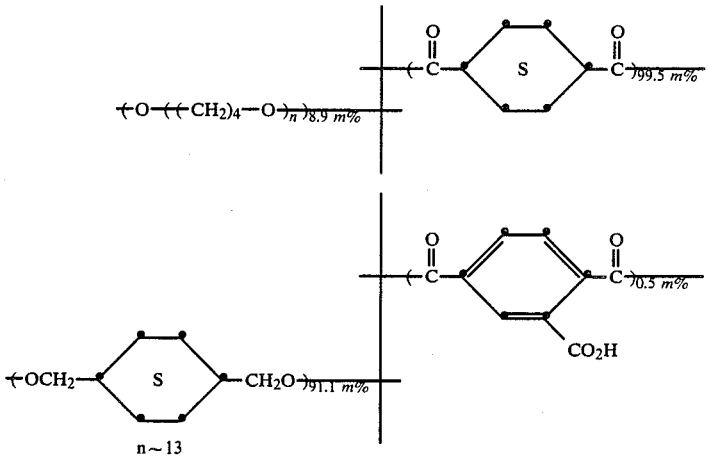

In a preferred embodiment of the invention, the thermoplastic binder is a styrene-acrylonitrile copolymer.

The amount of polymeric binder used in the slipping layer of the invention is not critical. In general the polymeric binder may be present in an amount of from about 0.1 to about 2 g/m$^2$, representing from about 1 to about 80% of the total layer coverage.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippoin Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

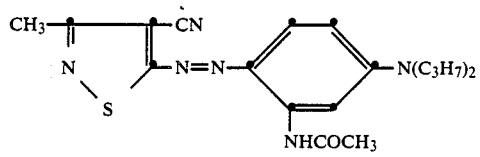

(magenta)

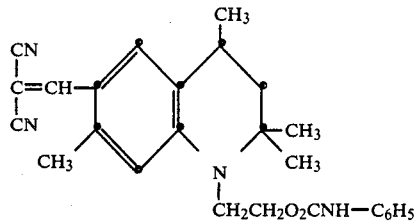

(yellow)

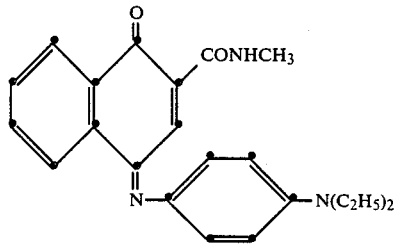

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) of a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such a polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 μm. It may also be coated with a subbing layer, if desired.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed,it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1

A dye-receiving element was prepared by coating 2.9 g/m$^2$ of Makrolon 5705® polycarbonate resin (Bayer A. G.), 1,4-didecoxy-2,5-dimethoxybenzene (0.32 g/m$^2$) and FC-431® (3M Corp.) surfactant (0.016 g/m$^2$) using a solvent mixture of methylene chloride and trichloroethylene on a titanium dioxide-containing 175 μm poly(ethylene terephthalate) support.

A cyan dye-donor element was prepared by coating on a 6 μm poly(ethylene terephthalate) support a dye layer containing the following cyan dye (0.28 g/m$^2$), duPont DLX-6000 Teflon® micropowder (0.016 g/m$^2$), and FC-431®(3M Corp.) surfactant (0.009 g/m$^2$) in a cellulose acetate butyrate (14% acetyl, 38% butyryl) binder (0.50 g/m$^2$) coated from a toluene/methanol solvent mixture.

Cyan dye:

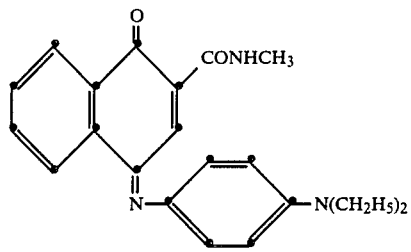

On the back side of the dye-donor, a subbing layer as described in Application Ser. No. 923,443, of Harrison, Kan and Vanier, filed Oct. 27, 1986, entitled "Polyester Subbing Layer for Slipping Layer of Dye-Donor Element Used in Thermal Dye Transfer" was coated followed by various slipping layers coated from solvent mixtures of propyl acetate, butanone, butyl acetate and methanol as follows:

Control 1—Support only. No layer.

Control 2—Binder only of poly(styrene-co-acrylonitrile) (70:30 wt. ratio) (0.54 g/m$^2$).

Control 3—Binder and silicone material: poly(styrene-co-acrylonitrile) (70:30 wt. ratio) (0.54 g/m$^2$) and BYK-320 silicone (0.0054 g/m$^2$).

Control 4—Binder and phosphate ester: poly(styrene-co-acrylonitrile) (70:30 wt. ratio) (0.54 g/m$^2$) and Zonyl UR phosphate ester (0.054 g/m$^2$).

Control 5—Binder and phosphate ester at lower concentration: poly(styrene-co-acrylonitrile) (70:30 wt. ratio) (0.54 g/m$^2$) and Zonyl UR phosphate ester (0.022 g/m$^2$).

Control 6—Neutralized phosphate ester with surfactant: Neutralized Zonyl UR phosphate ester (0.054 g/m$^2$) and Aerosol OT (an anionic surfactant from American Cyanamid) (0.0027 g/m$^2$) coated without binder from a methanol/water solvent.

Slipping Layer 1 of Invention—Binder, silicone material and phosphate ester: poly(styrene-co-acrylonitrile) (70:30 wt. ratio) (0.54 g/m$^2$), BYK-320 silicone (0.011 g/m$^2$) and Zonyl UR phosphate ester (0.054 g/m$^2$).

Slipping Layer 2 of Invention—Binder, silicone material and phosphate ester at lower concentration: poly(styrene-co-acrylonitrile) (70:30 wt. ratio) (0.54 g/m$^2$), BYK-320 silicone (0.0054 g/m$^2$) and Zonyl UR phosphate ester (0.022 g/m$^2$).

The dye side of each dye-donor element strip 1.25 inches (32 mm) wide was placed in contact with the dye image-receiving layer of the dye-receiver element of the same width. The assemblage was fastened in the jaws of a stepper motor driven pulling device. The assemblage was laid on top of a 0.55 inch (14 mm) diameter rubber roller and a TDK Thermal Head (No. L-133) was pressed with a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated from 0 up to 8.3 msec to generate an "area test pattern" of given density. The voltage supplied to the print head was approximately 22 v representing approximately 1.6 watts/dot (13 mjoules/dot) for maximum power to the 0.1 mm$^2$ area pixel.

As each 'area test pattern' of the given density was being generated, the force required for the pulling-device to draw the assemblage between the print-head and roller was measured using a Himmelstein Corp. 10010 Strain Gauge (10 lb. range) and 6-205 Conditioning Module.

The following results were obtained at various steps of the test pattern:

TABLE 1

| Slipping Layer | Relative Force (lbs) Step 0 (D-min) (D ~0.08) | Step 2 (D ~0.3) | Step 4 (D ~1.1) | Step 8 (D-max) (D ~2.4) |
|---|---|---|---|---|
| Control 1 | 4.6 | 7.2 | Tore | Tore |
| Control 2 | >8.4 | >8.4 | >8.4 | 7.5 |
| Control 3 | 6.0 | 7.3 | 5.1 | 4.8 |
| Control 4 | 5.2 | 4.7 | 4.3 | 4.1 |
| Control 5 | 5.7 | 5.4 | 4.6 | 4.2 |
| Control 6 | 5.6 | 5.2 | 5.2 | 5.2 |
| Invention 1 | 4.4 | 4.3 | 4.2 | 3.9 |
| Invention 2 | 5.5 | 5.1 | 4.3 | 4.0 |

The above data shows that the slipping layer composition of the invention minimizes the force required for passage through the thermal head in comparison to various control materials. In particular, when both the silicone polymer and the phosphate ester in the same amounts as the controls were added to the binder, the relative force went down to an amount which is better than the result obtained with either material alone.

EXAMPLE 2

A dye-receiving element was prepared as in Example 1.

A cyan dye-donor element was prepared by coating on a 6 μm poly(ethylene terephthalate) support a dye layer containing the same cyan dye as in Example 1 (0.28 g/m$^2$) and duPont DLX-6000 Teflon® micropowder (0.016 g/m$^2$) in a cellulose acetate propionate (2.5% acetyl, 45% propionyl) binder (0.44 g/m$^2$) coated from a toluene, methanol and cyclopentanone solvent mixture.

On the back side of the dye-donor, a subbing layer as described in Application Ser. No. 923,443, of Harrison, Kan and Vanier, filed Oct. 27, 1986, entitled "Polyester Subbing Layer for Slipping Layer of Dye-Donor Element Used in Thermal Dye Transfer" was coated. On top of this subbing layer, various slipping layers of a phosphate ester and a silicone component were coated in a poly(styrene-co-acrylonitrile) binder (70:30 wt. ratio) (0.54 g/m$^2$) from either a toluene and 3-pentanone or toluene and methanol solvent mixture.

The phosphate esters used were duPont Zonyl UR® Fluorosurfactant, described above, and Gafac RA-600® (GAF Corp.), described above. The silicone used was BYK-320® (BYK-Chemie USA), described above.

The elements were processed as in Example 1 to give the following results:

TABLE 2

| Phosphate Ester (g/m$^2$) | Silicone (g/m$^2$) | Relative force (lbs) Step 2 (D ~0.3) |
|---|---|---|
| Controls | | |
| Zonyl (0) | 0.011 | 3.7 |
| Zonyl (0) | 0.032 | 2.5 |
| Zonyl (0.011) | 0 | 2.7 |
| Zonyl (0.032) | 0 | 2.0 |

TABLE 2-continued

| Phosphate Ester ($g/m^2$) | Silicone ($g/m^2$) | Relative force (lbs) Step 2 (D ~0.3) |
|---|---|---|
| Invention | | |
| Zonyl (0.011) | 0.011 | 1.4 |
| Zonyl (0.032) | 0.032 | 1.4 |
| Controls | | |
| Gafac (0) | 0.011 | 3.2 |
| Gafac (0) | 0.032 | 3.3 |
| Gafac (0.011) | 0 | 3.0 |
| Gafac (0.032) | 0 | 1.5 |
| Invention | | |
| Gafac (0.011) | 0.011 | 1.3 |
| Gafac (0.032) | 0.032 | 1.4 |

The above data show that use of the phosphate ester component or the silicone component alone requires much greater force for passage through the thermal head than use of a lower total quantity of the combined components. When either phosphate ester was used in combination with the silicone, equally good results were obtained at low or high coverages.

EXAMPLE 3

Different Binders

A dye-receiver was prepared as in Example 1. Dye-donors were prepared as in Example 2 except that on top of the subbing layer, various slipping layers of Gafac RA-320® phosphate ester and BYK-320® silicone were coated at the indicated level in either a poly(-methylmethacrylate) or General Electric Lexan 141® bisphenol-A polycarbonate binder (0.54 $g/m^2$) from a toluene and 3-pentanone solvent mixture.

The elements were processed as in Example 1 to give the following results:

TABLE 3

| Poly(methylmethacrylate) Binder | | |
|---|---|---|
| Phosphate Ester ($g/m^2$) | Silicone ($g/m^2$) | Relative force (lbs) Step 2 (D ~0.3) |
| Controls | | |
| (0) | 0 | 4.5 |
| (0) | 0.022 | 2.5 |
| (0.022) | 0 | 4.4 |
| Invention | | |
| (0.011) | 0.011 | 1.8 |
| (0.022) | 0.022 | 1.6 |

TABLE 4

| Bisphenol-A Polycarbonate Binder | | |
|---|---|---|
| Phosphate Ester ($g/m^2$) | Silicone ($g/m^2$) | Relative force (lbs) Step 2 (D ~0.3) |
| Controls | | |
| (0) | 0 | 4.7 |
| (0) | 0.022 | 2.2 |
| (0.022) | 0 | 2.3 |
| Invention | | |
| (0.011) | 0.011 | 2.1 |
| (0.022) | 0.022 | 1.8 |

The above data show that irrespective of the binder used, combinations of a partial phosphate ester and silicone polymer effectively reduce the force for passage through the thermal head.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising a lubricating material dispersed in a polymeric binder, the improvement wherein said lubricating material comprises a partially esterified phosphate ester and a silicone polymer comprising units of a linear or branched alkyl or aryl siloxane.

2. The element of claim 1 wherein said silicone material is present in an amount of from about 0.0005 to about 0.05 $g/m^2$, representing approximately 0.1 to 10% of the binder weight, the phosphate ester is present in an amount of from about 0.001 to about 0.150 $g/m^2$, representing approximately 0.2 to 30% of the binder weight, and the polymeric binder is a thermoplastic binder representing about 1 to about 80% of the total layer coverage.

3. The element of claim 2 wherein said thermoplastic binder is a styrene-acrylonitrile copolymer.

4. The element of claim 1 wherein said silicone polymer is a copolymer of a polyalkylene oxide and a methyl alkylsiloxane.

5. The element of claim 1 wherein said partially esterified phosphate ester contains one or two substituted or unsubstituted alkyl groups having from 5 to about 20 carbon atoms or one or two substituted or unsubstituted aryl groups having from about 6 to about 20 carbon atoms, such groups having from 0 to about 30 linking groups.

6. The element of claim 5 wherein said partially esterified phosphate ester contains one or two fluorinated alkyl or aryl groups.

7. The element of claim 6 wherein said ester is $$(CF_3(CF_2)_{5-15}CH_2CH_2O)_{1\ or\ 2}\overset{O}{\overset{\uparrow}{P}}-(OH)_{2\ or\ 1}.$$

8. The element of claim 1 wherein said support comprises poly(ethylene terephthalate).

9. The element of claim 8 wherein said dye layer comprises sequential repeating areas of cyan, magenta and yellow dye.

10. In a process of forming a dye transfer image comprising (a) imagewise-heating a dye-donor element comprising a support having on one side thereof a dye layer and on the other side a slipping layer comprising a lubricating material dispersed in a polymeric binder, and (b) transferring a dye image to a dye-receiving element to form said dye transfer image, the improvement wherein said lubricating material comprises a partially esterified phosphate ester and a silicone polymer comprising units of a linear or branched alkyl or aryl siloxane.

11. The process of claim 10 wherein said silicone material is present in an amount of from about 0.0005 to about 0.05 $g/m^2$, representing approximately 0.1 to 10% of the binder weight, the phosphate ester is present in an amount of from about 0.001 to about 0.150 $g/m^2$, representing approximately 0.2 to 30% of the binder weight, and the polymeric binder is a thermoplastic binder representing about 1 to about 80% of the total layer coverage.

12. The process of claim 10 wherein said silicone polymer is a copolymer of a polyalkylene oxide and a methyl alkylsiloxane and said partially esterified phosphate ester contains one or two substituted or unsubstituted alkyl groups having from 5 to about 20 carbon atoms or one or two substituted of unsubstituted aryl groups having from about 6 to about 20 carbon atoms, such groups having from 0 to about 30 linking groups.

13. The process of claim 10 wherein said support is poly(ethylene terephthalate) which is coated with sequential repeating areas of cyan, magenta and yellow dye, and said process steps are sequentially performed for each color to obtain a three-color dye transfer image.

14. In a thermal dye transfer assemblage comprising:

(a) a dye-donor element comprising a support having one one side thereof a dye layer and on the other side a slipping layer comprising a lubricating material dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said lubricating material comprises a partially esterified phosphate ester and a silicone polymer comprising units of a linear or branched alkyl or aryl siloxane.

15. The assemblage of claim 14 wherein said silicone material is present in an amount of from about 0.0005 to about 0.05 g/m$^2$, representing approximately 0.1 to 10% of the binder weight, the phosphate ester is present in an amount of from about 0.001 to about 0.150 g/m$^2$, representing approximately 0.2 to 30% of the binder weight, and the polymeric binder is a thermoplastic binder representing about 1 to about 80% of the total layer coverage.

16. The assemblage of claim 15 wherein said thermoplastic binder is a styrene-acrylonitrile copolymer.

17. The assemblage of claim 14 wherein said silicone polymer is a copolymer of a polyalkylene oxide and a methyl alkylsiloxane.

18. The assemblage of claim 14 wherein said partially esterified phosphate ester contains one or two substituted or unsubstituted alkyl groups having from 5 to about 20 carbon atoms or one or two substituted or unsubstituted aryl groups having from about 6 to about 20 carbon atoms, such groups having from 0 to about 30 linking groups.

19. The assemblage of claim 18 wherein said partially esterified phosphate ester contains one or two fluorinated alkyl or aryl groups.

20. The assemblage of claim 19 wherein said ester is

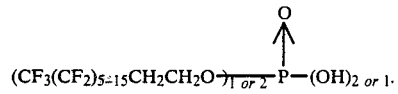

21. The assemblage of claim 14 wherein said support of the dye-donor element comprises poly(ethylene terephthalate).

22. The assemblage of claim 14 wherein said dye layer comprises sequential repeating areas of cyan, magenta and yellow dye.

* * * * *